US005096079A

United States Patent [19]

Odet

[11] Patent Number: 5,096,079

[45] Date of Patent: Mar. 17, 1992

[54] SCREW-ON STOPPER CAP, HAVING A TAMPER-PROOF BAND

[75] Inventor: Philippe Odet, Chasselay, France

[73] Assignee: Astra Plastique, France

[21] Appl. No.: 619,095

[22] Filed: Nov. 28, 1990

[30] Foreign Application Priority Data

Dec. 8, 1989 [FR] France ..... 89 16517

[51] Int. Cl.[5] ..... B65D 41/34

[52] U.S. Cl. ..... 215/252; 215/258

[58] Field of Search ..... 215/252, 258, 320, 230

[56] References Cited

U.S. PATENT DOCUMENTS

| | | | |
|---|---|---|---|
| 3,460,703 | 8/1969 | Leftault, Jr. | 215/252 |
| 3,484,012 | 12/1969 | White et al. | 215/252 |
| 4,157,144 | 6/1979 | Weiler et al. | 215/252 |
| 4,402,418 | 9/1983 | Ostrowsky . | |
| 4,432,461 | 2/1984 | Mumford et al. | 215/252 |
| 4,506,795 | 3/1985 | Herr . | |
| 4,526,282 | 7/1985 | Dutt et al. | 215/252 |
| 4,572,387 | 2/1986 | Luker et al. | 215/252 |
| 4,595,110 | 6/1986 | Herr . | |
| 4,657,153 | 4/1987 | Hayes | 215/252 |
| 4,709,824 | 12/1987 | Thompson | 215/252 |
| 4,753,360 | 6/1988 | Baxter | 215/252 |
| 4,801,030 | 12/1989 | Barriac | 215/252 |
| 4,936,474 | 6/1990 | Szczesniac et al. | 215/252 |

FOREIGN PATENT DOCUMENTS

| | | |
|---|---|---|
| 0049876 | 4/1982 | European Pat. Off. . |
| 0107680 | 4/1983 | European Pat. Off. . |
| 1213931 | 11/1958 | France . |
| 2290364 | 11/1974 | France . |
| 2525565 | 10/1983 | France . |
| 2033350 | 5/1980 | United Kingdom . |

*Primary Examiner*—Stephen Marcus
*Assistant Examiner*—Vanessa Caretto
*Attorney, Agent, or Firm*—Parkhurst, Wendel & Rossi

[57] ABSTRACT

A screw-on stopper cap, having a tamper-proof band, for a bottle with a counter-ring, of the type including a skirt, and of an annular anti-tamper collar connected to the skirt by breakable bridges and having on its bottom a plurality of articulated tabs which are folded back against the inside face of the collar, wherein the tabs are of constant section and include two parts, namely a first curved part, connected to the bottom of the collar and continued by a second rectilinear part, the joining portion between these two parts being intended to bear against the counter-ring, while the free rectilinear portion is intended to bear against the inside face of the collar.

2 Claims, 2 Drawing Sheets

SCREW-ON STOPPER CAP, HAVING A TAMPER-PROOF BAND

The invention relates to a new type of screw-on stopper cap, having a tamper-proof band.

Single-piece screw-on stopper caps having a tamper-proof band and made of plastic material are well known. Basically; these devices essentially comprise a screw-on cap proper and an annular safety collar which is connected to the skirt of the cap by a succession of bridges, produced in the molding, which can be broken by unscrewing.

Stopper caps of the type in question are known in which the annular safety collar has, on its inside face, tabs articulated to the base of the collar which are intended to be folded back against the inside so as to abut against a projection of the neck, in particular the counter-ring of the neck (see for example documents FR-A-1,213,931, 2,290,364, EP-A-0,049,876, GB-A-2,033,350 and U.S. Pat. Nos. 4,506,795 and 4,595,110).

It has been suggested in document EP-A-0,107,680 that thinner areas be made on the tabs and that they be continued by a thinner portion intended to jam between the inside face of the annular collar and the counter-ring after screwing on. Although successful on the market, this device nevertheless still has the disadvantage that, owing to the successive thinner portions, it is difficult to install on the neck, especially in an automatic way, precisely because of those portions of the tabs which are thinner in section and hence of variable rigidity, which sometimes create resistance to the proper screwing of the cap over a neck.

The invention overcomes these disadvantages. Its object is an improved stopper cap of the type in question which is easier to install.

This screw-on stopper cap, having a tamper-proof band, for a bottle with a neck which has a thread and a counter-ring, of the type consisting of a cap proper, the skirt of which is provided with an internal thread interacting with the thread of the neck, and of an annular anti-tamper collar connected at the top to the bottom of the skirt by a plurality of breakable bridges and having on its bottom a plurality of articulated tabs which are folded back against the inside face of the collar so as to abut against the counter-ring of the neck and pass over the edge of this counter-ring, wherein the tabs are of constant section and comprise two parts, namely a first curved part, connected to the bottom of the collar and continued by a second, free rectilinear part, a joining portion between these two parts being intended to bear against the counter-ring, while the free rectilinear part is intended to bear against the inside face of the collar.

In an alternative embodiment, the top of the inside face of the collar comprises a shoulder against which the end of the rectilinear part bears.

The way in which the invention can be executed and the consequent advantages will appear more clearly from the illustrative embodiments which follow, aided by the attached figures.

Figure 1:
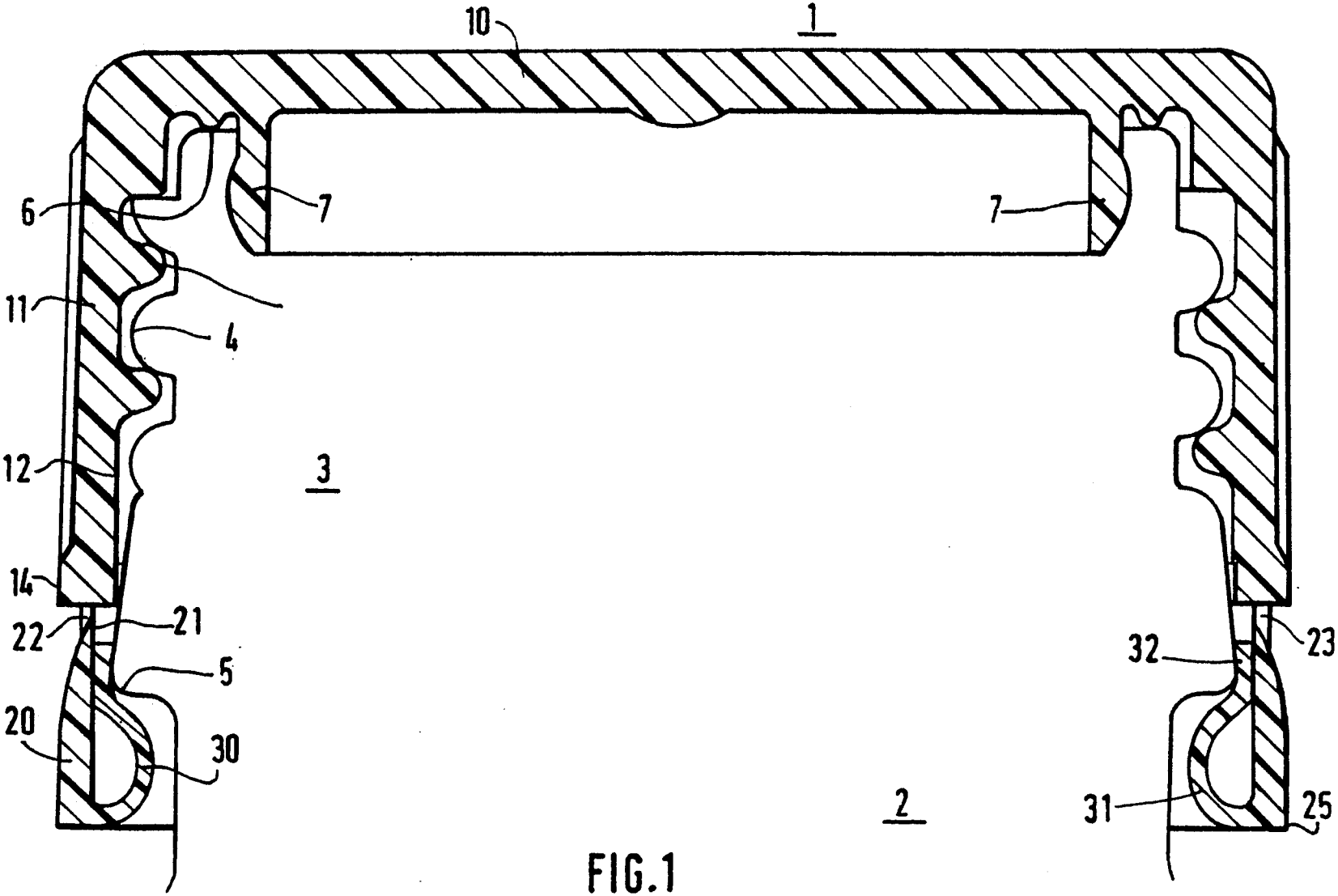
FIG. 1 shows a sectional view of a stopper cap in accordance with the invention.

A stopper cap according to the invention indicated by a general reference numeral (1), for a bottle indicated by general reference numeral (2), with a neck (3), which comprises a thread (4) and a counter-ring (5). Reference numeral (6) indicates a sealing ring intended to bear against the top of the neck, while reference numeral (7) indicates a sealing skirt intended to bear against the inside face of the neck.

This stopper cap (1) is composed essentially of a cap proper consisting of a ceiling (10) and an annular skirt (11), whose inside face (12) carries a thread (13) interacting with the thread (4) of the neck.

The cap (1) also comprises an annular anti-tamper collar (20) connected at the top (21) to the bottom (14) of the skirt (11) by a succession of breakable bridges (22, 23) at regular intervals, obtained directly from the molding. The bottom (25) of the collar (20) carries a succession of characteristic tabs (30) which are also at regular intervals and of a width determined beforehand according to the application envisaged.

Figure 2:
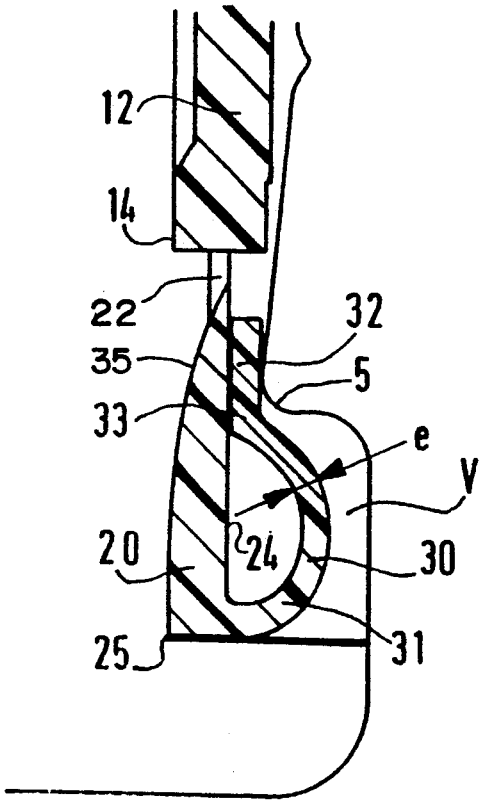
FIGS. 2 and 3 show in detail the characteristic tabs of the invention, respectively installed on a bottle (FIG. 2) and as produced by the molding (FIG. 3).

According to a first feature of the invention, these tabs (30) are of constant thickness (e) substantially their entire length as shown in FIG. 2.

According to another feature of the invention, these tabs (30) essentially comprise two parts, respectively a first curved part (31), connected to the bottom (25) of the collar (20) and continued by a second rectilinear part (32), a joining portion (33) between these two parts (31, 32) being intended to bear against the counter-ring (5).

Figure 3:
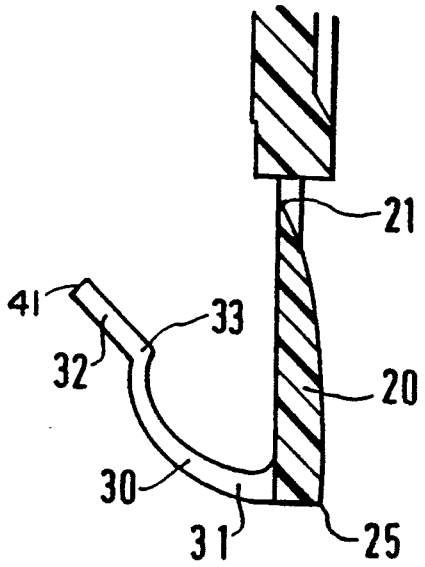

FIG. 3 shows in detail the tabs as produced by the molding and before screwing on, while FIG. 2 shows this same tab in the screwed-on position. It will be seen that when in position, the joining portion (33) bears against the counter-ring (5). When the skirt (11) is unscrewed, the portion (33) bears strongly against the counter-ring (5), and the curved portion (30) therefore tends to bow in the space V defined between the counter-ring (5) and the bottom of the anti-tamper collar (20). During this movement, the second rectilinear part (32) slides down the inside face (24) of the collar (20). A clean break of the bridges (22) results.

Figure 4:
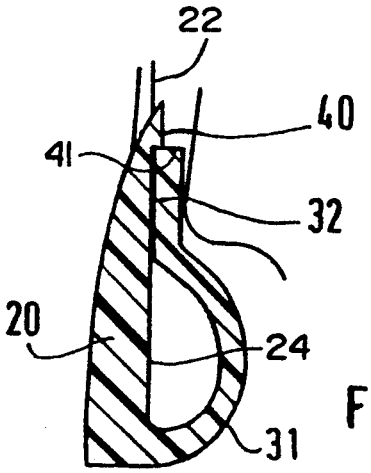
FIG. 4 shows an alternative embodiment.

In an alternative embodiment shown in FIG. 4, a top (35) of the inside face (24) of the annular anti-tamper collar (20) has a shoulder (40) in which the end (41) of the rectilinear part (32) of the tab (30) lodges in the screwed-on position.

Figure 5:
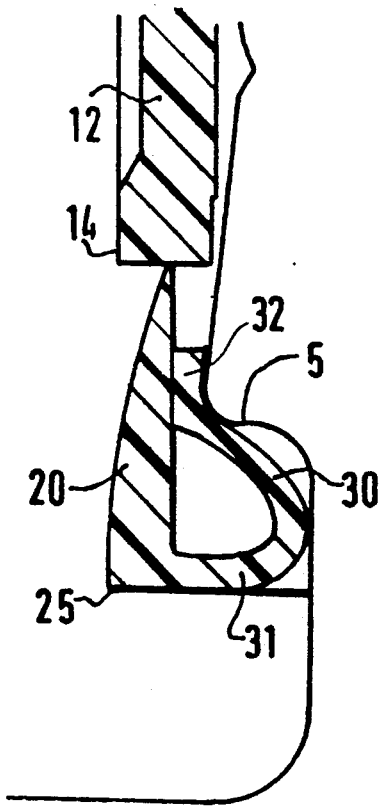
FIG. 5 shows in detail the characteristic tab of the invention, in the bowed position.

It is important that the characteristic tabs (30) have a cross-section of constant thickness (e) so that the whole locks on better. Thus, when the installed cap (1) is unscrewed, as it works its way around the turns of the thread (4) the tab (30) compresses, first bearing by way of the joining portion (33) against the base (5) of the counter-ring. As a result, the tabs (30) bow and become deformed (see FIG. 5) as the two extremities of the curved portion are brought towards each other. In this way a diameter of a portion of a circle formed by these tabs (30) is reduced. This increases the force applied to the breakable bridges (22). Hence, when the moment comes, a clean break of these bridges (22) results. Throughout this movement, the second rectilinear part (32) of the tabs slides down the inside wall (24) of the collar (20) to ensure good deformation.

In a known manner, these caps are made of plastic material, such as polyethylene or polypropylene in particular, and in a single piece.

This solution offers many advantages over solutions known to date, among others the solutions described in document EP-A-0,107,680 referred to in the preamble. The following may be mentioned:

the gradual deformability of the tabs during unscrewing, which as already said increases the grip of the collar beneath the counter-ring of the neck by a reduction in the diameter, because of the bowing, which produces a gradual stretching of the bridges and causes them to break cleanly;

more convenient installation, in particular by automatic capping machines, since the characteristic tabs exhibit constant and uniform flexibility over their entire length;

lastly, and consequently, greater anti-tamper security.

This type of cap can be used successfully in all known applications of these screw-on stopper caps, such as for example for drinks, pharmaceuticals or the like.

I claim:

1. A screw-on stopper cap for a bottle with a neck which has threads and a counter-ring arranged beneath the threads, the cap comprising:

a top portion;

an annular side skirt formed integrally with said top portion and having internal threads which communicate with the threads of the neck;

an annular anti-tamper collar disposed beneath a bottom surface of said skirt and including a downwardly extending section and a plurality of inwardly facing articulated tabs of constant cross section which are integrally connected to a bottom of said section, said tabs comprising a first curved part connected to the bottom of said section and a second rectilinear part which is joined to said first part by a joining portion and contiguous with an inner surface of said section; and a plurality of breakable bridges connected at one end to the bottom surface of said skirt and at another end to a top portion of said section;

wherein when the cap is unscrewed from the bottle the joining portion between said first part and said second part abuts against the counter-ring of the neck, thereby applying a force to the inner surface of said section which breaks said bridges.

2. The screw-on stopper cap of claim 1, wherein a top portion of said inner surface of said section comprises a shoulder which restricts upward movement of said second part.

* * * * *